US006484453B2

(12) United States Patent
Nocella

(10) Patent No.: US 6,484,453 B2
(45) **Date of Patent: *Nov. 26, 2002**

(54) ROOF DRAIN DE-ICER APPARATUS AND METHOD

(76) Inventor: Raymond L. Nocella, 162 Stagecoach Rd., Sicklerville, NJ (US) 08081

( * ) Notice: Subject to any disclaimer, the term of this patent is extended or adjusted under 35 U.S.C. 154(b) by 0 days.

This patent is subject to a terminal disclaimer.

(21) Appl. No.: 09/924,085

(22) Filed: Aug. 7, 2001

(65) Prior Publication Data

US 2001/0047627 A1 Dec. 6, 2001

Related U.S. Application Data

(62) Division of application No. 09/318,896, filed on May 26, 1999, now Pat. No. 6,282,846.

(51) Int. Cl.[7] ..... E04D 13/076
(52) U.S. Cl. ..... 52/24; 426/74; 119/51.03
(58) Field of Search ..... 52/24; 426/115, 426/116, 117, 125, 135; 119/51.03; D1/100, 107; D25/113

(56) References Cited

U.S. PATENT DOCUMENTS 1,685,392 A * 9/1928 Beadle
2,077,300 A * 4/1937 Abrams et al.
2,139,910 A 12/1938 Patten
2,142,825 A 1/1939 Patten
2,658,476 A * 11/1953 Futter ..... 426/115
2,682,475 A * 6/1954 Smith
2,833,247 A * 5/1958 Beyea
3,653,926 A 4/1972 Armellino
4,041,656 A 8/1977 Anderson
4,150,162 A 4/1979 Goldstein et al.
4,378,908 A 4/1983 Wood
4,437,432 A * 3/1984 Immeyer et al. ..... 119/18
D372,791 S * 8/1996 Berendsen et al. ..... D1/107
D375,181 S 11/1996 Tourney et al.
5,622,739 A 4/1997 Benton et al.
5,630,375 A 5/1997 Mann
5,836,053 A 11/1998 Davignon et al.
D428,232 S 7/2000 Thornberg
6,101,685 A 8/2000 Archibald et al.
6,120,817 A 9/2000 Archibald et al.
6,126,975 A 10/2000 Archibald et al.
6,132,780 A 10/2000 Archibald et al.
6,282,846 B1 * 9/2001 Nocella ..... 52/24

* cited by examiner

*Primary Examiner*—Blair M. Johnson
*Assistant Examiner*—Erica B. Harris
(74) *Attorney, Agent, or Firm*—Volpe and Koenig, P.C.

(57) ABSTRACT

A de-icer formed of a solid block of a pressed, granulated salt has at least a top portion water-proofed to prevent rapid deterioration due to precipitation. An exposed bottom surface is in contact with the upper surface of a flat, sloped roof to provide wicking absorption of water flowing down the roof into the salt. Absorption of water by the salt leads to release of the resulting saline solution to the surface of the roof, preventing formation of ice on the roof downstream of the de-icer and in the roof drain. The de-icer may be maintained in place on the surface of the roof by an adhesive tape, or by its own weight.

8 Claims, 3 Drawing Sheets

ROOF DRAIN DE-ICER APPARATUS AND METHOD

CROSS-REFERENCE TO RELATED APPLICATIONS

This application is a division of U.S. patent application Ser. No. 09/318,896, filed May 26, 1999 now U.S. Pat. No. 6,282,846.

SUMMARY

The present invention relates to a method and apparatus for preventing ice from forming at a roof drain and for preventing the build-up of ice and/or snow in the region of a roof drain which, in turn, assures flow of water accumulating on the roof, down the drain. This is accomplished by affixing a partially perforated waterproof container within which salt is packed, on the surface of the roof such that water flowing down the roof is drawn into the salt and subsequently gravity discharged onto the roof, flowing toward the roof drain and downspout system, mixing with water, snow and/or ice in the region of the roof drain to melt the snow and ice and thereby prevent the build up of ice at or over the roof drain which would, in turn, result in blockage of the roof drain.

BACKGROUND

The Roof Drain De-icer Apparatus is a gravity-fed, ice melting system designed to prevent the formation of ice dams at the lower part of flat and/or inclined roofs and ice build-up and water accumulation in the roof drainage system. Ice dams are a cumulative build-up of ice at the gutter and roof drain areas of roofs, which form as a result of the daily thawing and re-freezing of the snow and ice on the roof surface. Accumulation of ice in the region of the roof drain blocks the runoff of melted water off the roof, which makes the ice dam situation more problematic. When the roof drain is blocked with ice or frozen water, the down spouts, gutters and drain box fill up with water which expands when the water freezes causing damage to the roof and the drainage system and the components thereof. Installation of a Roof Drain De-icer system of the present invention prevents this damage. The Roof Drain De-icer apparatus becomes non-operational when the water or snow on the surface of the roof upstream of the De-icer Apparatus freezes.

Means for de-icing or for preventing the formation of ice on the surface of a flat, sloped roof and in the roof drainage system through which water flows, is described in the prior art. However, such teachings are clearly distinguishable from the present invention.

The Park U.S. Pat. No. 133,247 utilizes alum and salt to saturate the roof sheeting and to also saturate the felt roofing paper. Several layers of felt roofing paper saturated with alum and salt, as well as a layer of dry salt and resin and tallow are installed prior to the installation of the roof tiles. In Park, the layer of dry salt as well as the felt roofing paper and the sheeting saturated with alum and salt do not draw water from the surface of the roof and is distinguishable from the present invention. Also, replacement of the alum and salt requires removal of the roof tiles, which is highly impractical.

The Anderson U.S. Pat. No. 4,041,656 discloses a device for draining melting snow. Noting FIGS. 1 through 5, Anderson provides a collection tube 12 open at each end and provided with an inner-tubular portion 24 telescopingly received within tubular portion 14 to change the overall length. A screen 40 is provided within the collection tube 12 and is filled with salt. Screen 50 has an end portion 49 which maintains the salt within the screen. Gutter members 7 and 80 are arranged to form a V shape for directing water to the upper open end of the device. The water passes into and through the device beneath the screen but remains in a liquid state. The water runs outwardly from the lower end of the device. Anderson describes that when the water freezes to ice it reaches screen 50, causing the salt to melt the ice during the following day when melting again occurs and water runs over the ice formed in the tube causing the ice to melt. There is no teaching of water or melting snow flowing down a roof surface to a salt reservoir, which draws water into the salt to produce a saline solution within the reservoir and gravity flow of the saline solution from the reservoir onto the surface of the roof to mix with and melt snow and/or ice, preventing blockage of the drainage system as disclosed in the present invention.

The Guth U.S. Pat. No. 3,771,188 discloses a portable device having electric heating tiles 4 and 18 as well as a device for dispensing "a melting aid". The Guth device is held above a region where ice is formed and cord 8 is pulled in a direction shown by an arrow in FIG. 2 to open gate 14 and dispense the material. Although Guth describes the invention as being usable on a roof of a building, the structure is intended to be manually operated, the material is dispensed to melt ice and there is no teaching of drawing snow, ice or water into a salt-filled enclosure and subsequent production and release of a saline solution from within the enclosure onto the roof.

BRIEF DESCRIPTION OF THE INVENTION

The present invention provides a novel method and apparatus for de-icing a roof drain. The invention, in one preferred embodiment, comprises a container fabricated of a sleeve of waterproof material defining a hollow interior space. Portions of the upper and lower surfaces of the container are perforated with small holes. Rock salt, common salt or other stable, solid material capable of melting snow and ice, is packed in the annular space of the container. The free ends of the container are affixed to the surface of the roof adjacent to the roof drain with the perforated surface portions of the container being arranged in contact with the roof surface in the upstream direction relative to the flow of water toward the roof drain. The lower surface of the container engages the surface of the roof.

Water, snow or ice in the region of the upper and/or lower perforated regions are drawn into the container by the salt, forming a saline solution. Salt within the container dissolves into the water, which subsequently drains out from the perforations as a saline solution which flows along the roof toward the roof drain preventing formation of ice downstream of the de-icing apparatus and in the region of the roof drain. The saline solution combines and mixes with water in the region between the De-icer and roof drain to facilitate melting and/or prevent freezing.

OBJECTS OF THE INVENTION

Ice build up in roof drainage systems and especially roof drains causes ice and melting snow on the roof to block the flow of water, causing the roof drain to overflow, resulting in possible deterioration and structural damage to the roof and the building structure therebeneath. Also, accumulated water in the roof drain freezes, causing damage to the gutter, downspout and roof drainage system.

It is therefore one object of the invention to provide a novel method and apparatus for maintaining the roof drain free of ice and prevent ice and water build-up in the roof drain system and on the roof.

Another object of the present invention is to maintain the surface of the roof, downstream of the de-icing apparatus, free of ice.

Still another object of the present invention is to provide a novel roof de-icer apparatus in broken-down, compact kit form and which is easy to assemble and put into use.

DETAILED DESCRIPTION OF THE PREFERRED EMBODIMENTS

Figure 1A:
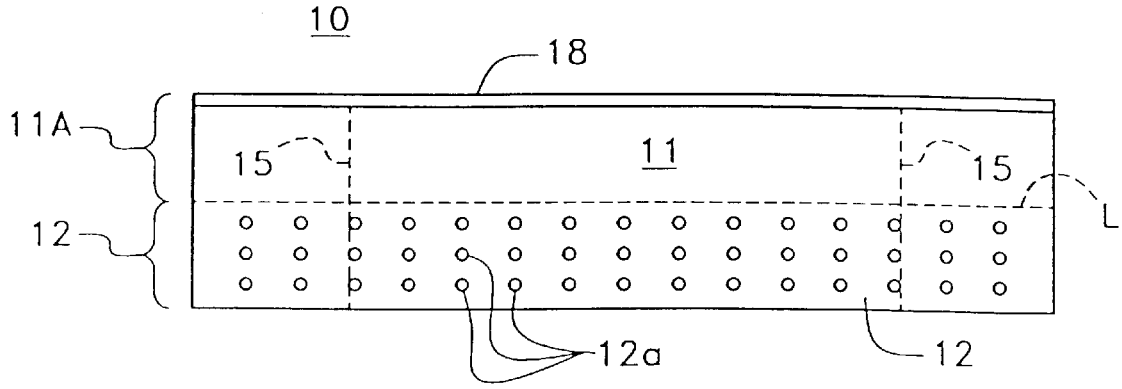
FIG. 1*a* is a side view of the waterproof container of the present invention, when empty, showing a portion of the lower perforated surface of the container when filled with salt, showing the dotted lines at which the container is tied off near the ends thereof by suitable ties and further showing a portion of the upper surface of the container when filled with salt.
Figure 5:
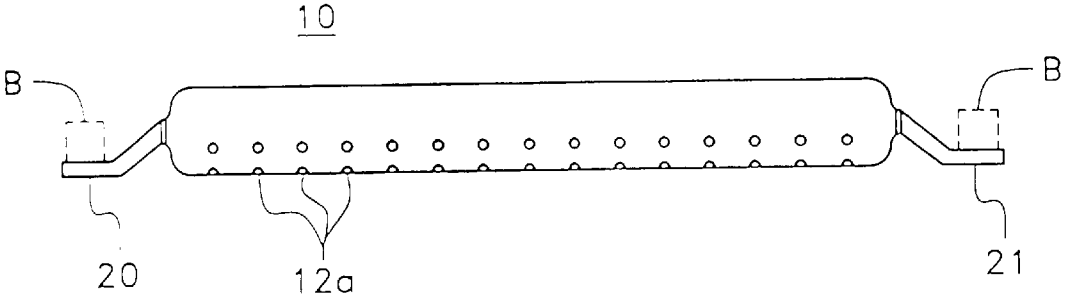
FIG. 5 is an elevational view of the container of FIG. 1*a* shown arranged on a roof surface and looking downstream in the direction of the upstream side of the container.

FIG. 1*a* shows an elevational view of container 10 substantially comprised of upper surface 11 and lower surface 12, formed of a waterproof plastic material of a suitable gauge to withstand the elements throughout a winter season, for example. Dotted line L represents the imaginary dividing line between the upper half 11 and the lower half 12 of the container 10. The container is preferably formed of a substantially transparent plastic but may be translucent or opaque, if desired. In use, the container 10 is positioned so that the surfaces 11 and 12 are arranged one above the other, with surface 12 resting upon the roof (see FIGS. 2, 3, and 5). Surfaces 11 and 12 may be formed of sheets which are bonded along their longitudinal side edges to create a sleeve defining a hollow interior space. Alternatively, the sleeve may be produced so as to be seamless, or may be folded over and joined along one longitudinal seam. The lower surface 12 is perforated at regular intervals with small holes 12*a* (FIGS. 1*a*–1*c*).

Figure 1B:
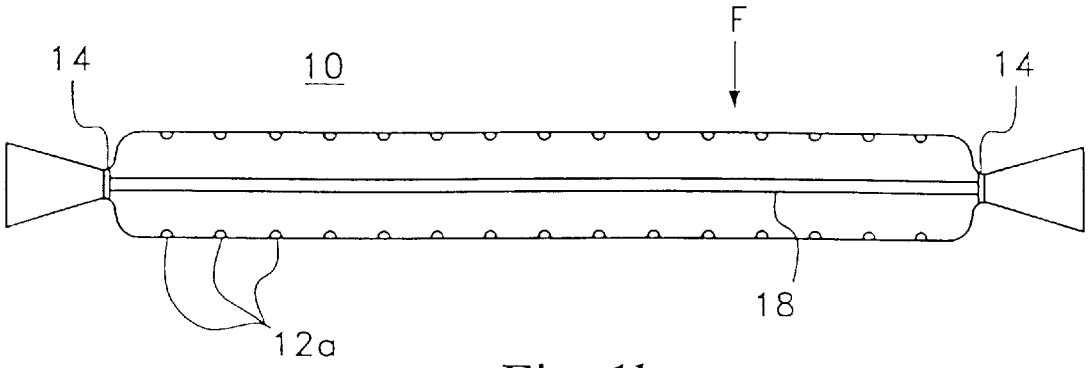
FIGS. 1*b* and 1*c* are top and bottom views of the waterproof container of FIG. 1 when filled with salt.
Figure 1C:
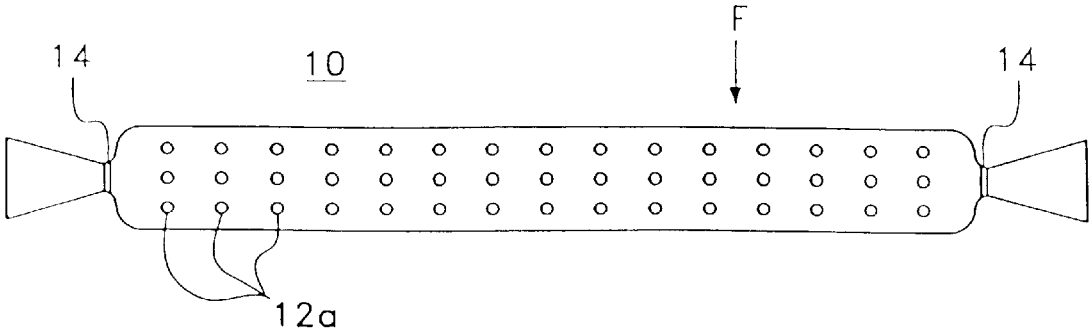
Figure 4:
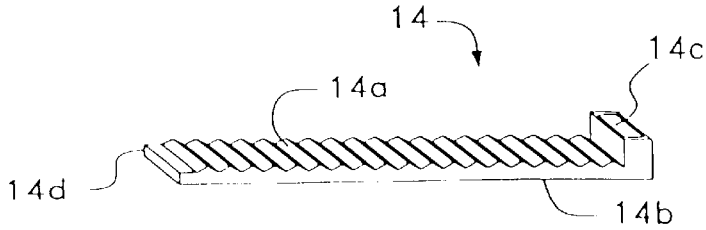
FIG. 4 shows one of the ties utilized to close off the ends of the container of FIG. 1*a*.

FIGS. 1*b* and 1*c* are plan views of the upper and lower surfaces. The two surfaces (sheets), in one embodiment, are integrally joined at opposite sides along their length and their ends are left open to permit the annular space created therein to be packed with salt. One of the ties 14 (see FIG. 4) is employed to close off the container near one end thereof. The container is then filled with salt. Subsequent to filling the hollow interior space with salt, the opposite end of the container is closed employing the remaining ones of the ties 14. The ties 14, 14 are positioned along the dotted guide lines 15 and 16 (shown in FIG. 1*a*). Procedurally, one end of sleeve 10 is closed using one of the ties 14. The ties 14 (see FIG. 4) are knurled along surface 14*a* forming a saw-tooth-like surface. One end 14*b* of the tie is provided with an opening 14*c*, through which the end 14*d* is inserted. The tie is pulled tight, closing one end of the container 10. The opening 14*c* is designed to prevent the end 14*d* from being pulled out of the opening, as is conventional. However, any other suitable ties may be utilized, if desired. The dotted lines 15, 16 printed on the container, serve as guides to identify where the ties should be located and the level to which the salt should be filled. With one end of the container being closed, the container is filled with rock salt or other suitable granular material suitable for melting snow and ice and/or significantly lowering the temperature at which water freezes. The still-open end of container 10 is then sealed using the remaining tie, placed at guide line 16.

Figure 3:
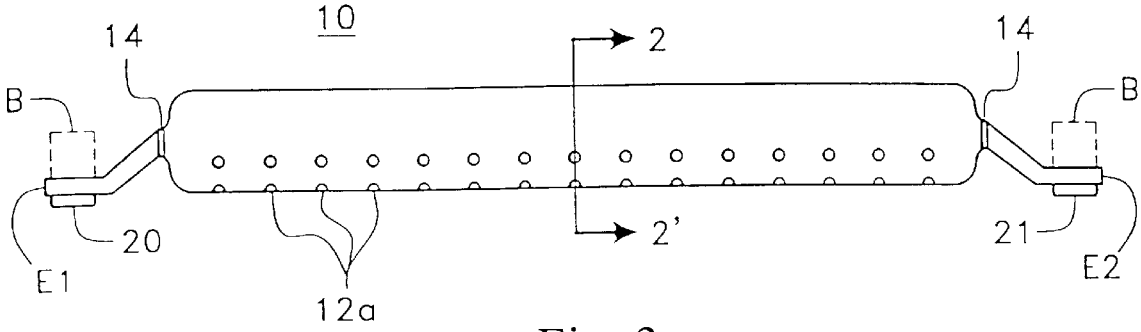
FIG. 3 is an elevational view of the container of FIG. 2 packed with salt and positioned on a roof surface and looking in the upstream direction at the downstream side of the container.

FIG. 3 shows a sectional view of the waterproof container packed with salt S. The ends of the flexible container are tied with cable ties 14, 14 to retain the salt within the container (see FIGS. 1*b*, 1*c*, and 3).

Figure 2:
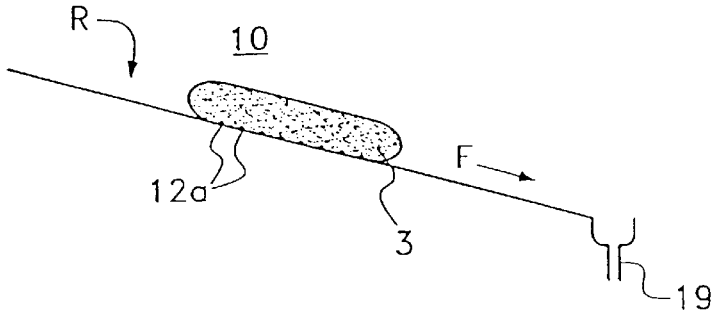
FIG. 2 is a cross-sectional view of the container of FIG. 1*a* resting on a roof surface and looking in the direction of arrows 2-2' of FIG. 3, the container being packed with salt, each end of the container being tied with a cable tie along the dotted lines shown in FIG. 1*a* after salt is filled in the container between the dotted lines.

FIG. 2 shows a sectional view of the waterproof container packed with salt 3, the container with salt positioned on a somewhat inclined portion of a roof R adjacent to a roof drain 19 with the lower surface 12 resting on the roof and perforated surface portion 12*a* of the container being arranged so that as many of the openings 12*a* as is practicable are on the bottom and facing the surface of the roof.

The invention comprises an apparatus for use on a roof comprising a water-proof container which may be of any shape. The lower surface 12 of the container (which is placed in contact with the surface of the roof R), is perforated at regular intervals with a plurality of relatively small holes 12*a* as shown in FIGS. 1*b*, 1*c*, and 3. The container is filled, preferably with common salt or rock salt 3 (or other granular material suitable for melting ice) and the ends of the container are tied with cable ties 14 or other securing means to retain the salt within the container as shown in FIG. 3.

The container may be generally cylindrical, spherical or rectangular in shape. The container may be fabricated of a flexible material such as a sheet of plastic or from a rigid material such as rigid plastic or polyfoam. Since the material is quite flexible, it is quite simple to substantially "flatten" the upper and lower surfaces. The ends E1, E2 of the container are held against the roof by a suitable adhesive tape epoxy or glue 21, 22, (preferably water-proof) able to withstand the elements normally encountered during the winter months.

As the water or melting snow flows along the roof, generally in the direction of flow F, it comes into contact with the perforated surface 12 and is drawn through the perforations 12*a* and into the interior of the container by the absorbing action of the salt packed in the interior space of the container. Some of the salt dissolves in the water, producing a saline solution which subsequently flows out through the perforations 12*a* and onto the surface of the roof R, and eventually towards the roof drain 19. The dissolved salt in the saline solution reduces the freezing point of water to below 30 degrees Fahrenheit and prevents melting snow or fresh snow from freezing in the gutter and roof drain 19. The water carrying the dissolved salt flows beneath and/or around the container 10. The small openings in the lower surface 12 of the container substantially retains the salt within the container while allowing the water to be initially drawn into the container and thereafter the saline solution to freely flow into and out of the container. In the preferred embodiment, the openings 12*a* have a diameter of the order of 3/16 inch. Limiting the perforations 12*a* to the downstream portions of surfaces, as opposed to providing spaced openings of substantially the entire area of surfaces 11, 12 increases the useful operating life of the de-icer without reducing operating efficiency.

A similar action takes place on upstream surface 11 wherein water, snow or ice enters perforations 12*a*, being drawn by the salt S into the interior of the container. The container filled with salt S is held on the surface of the roof R by an adhesive tape or removable adhesive epoxy or glue applied in the regions 20, 21 (see FIG. 5). Alternatively, heavy objects, such as bricks B may be placed upon regions 20, 21 to hold the container in place.

The roof de-icer apparatus 10 thus prevents the formation of ice dams in the region of the roof and gutter adjacent to the roof drain whereby melting snow and ice would otherwise tend to accumulate and prevent the drainage of water through the roof drain 19, and thereby preventing melting ice and water form accumulating and re-freezing in the drainage system, as well as the gutter and downspout.

In a preferred embodiment of the invention, a de-icer kit, adapted for sale in stores, comprises plastic sleeve 10 having perforations 12*a* along bottom surface 12. Dotted guide lines 15 and 16 (printed in red in the preferred embodiment), arranged perpendicular to the length of sleeve 10, and located approximately 6 inches inward from each end of the sleeve, as shown in FIG. 1*a*, are provided as guides to indicate the location at which the sleeve should be closed off by the ties 14. In addition, a line 18 (made of a contrasting color, such as blue, in the preferred embodiment) is printed along the upper side 11 of the sleeve and mid-way between the imaginary dividing lines (see line L in FIG. 1) which lie between the upper and lower sides 11 and 12 of the container 10, the blue line 18 identifying to the installer, the top side of the container 10.

The kit preferably includes a simple set of instructions which sets forth the following:

Place cable tie across one (red) dotted line (15) and fasten securely.

Fill sleeve (10) with rock salt to a level slightly below the other (red) dotted line (16).

Close the other end of the sleeve (10) at the second (red) dotted line (16) with the other cable tie (14).

Position sleeve (10) containing the rock salt with the perforations of the sleeve on surface 12 placed down and on the surface of the roof approximately one to two feet from the roof drain opening, in path of water and melting snow and positioned downstream relative to the normal flow toward the roof drain. The "blue" line 18 should be located facing upwardly (to the sky) and lie mid-way between the sides of the container (shown as imaginary line L). The container is thus placed so that the blue line is substantially equidistant from the sides of container 10.

Retain both ends of sleeve (10) upon the surface of the roof with adhesive tape, enclosed. Or place a weight such as a brick B on top of each end portion of the sleeve (10) extending between the dotted lines and the ends thereof to hold container 10 in place on the surface of roof (nails brads or other piercing objects should not be used to prevent damage to the roof and to prevent the unwanted flow of water through such openings).

Figure 6:
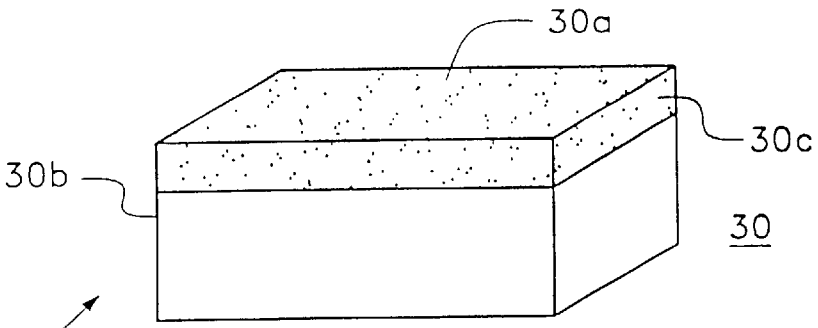
FIG. 6 is a perspective view showing another preferred embodiment of the present invention.
Figure 6A:
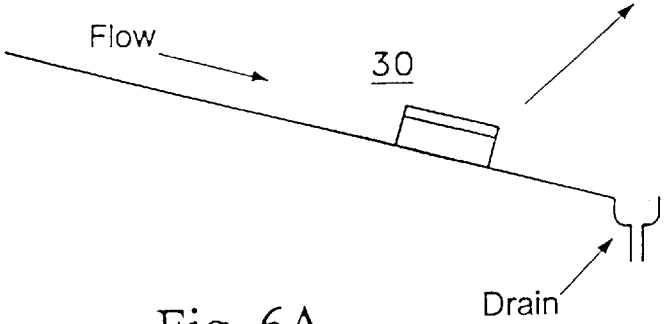
FIG. 6A shows the embodiment of FIG. 6 arranged along a sloping roof adjacent a roof drain.

Another preferred embodiment of the present invention is shown in FIGS. 6 and 6*a* which comprises a solid block of pressed salt 30 which is coated with a water-proof material, such as wax, forming a water-proof layer along top surface 30*a* and at least partially along the upper portions of the side surfaces, such as for example, the side surfaces 30*b* and 30*c* as shown in FIG. 6. The other side surfaces are coated in a like manner. The block of pressed salt, which is preferably in the shape of a rectangular parallelepiped, is typically of a weight which is sufficient to retain its position along a sloping roof, as shown in FIG. 6*a*. The water-proof coatings reduce the loss from rain and air moisture, but does not effect the efficiency of the unit. The use of the embodiment 30, shown in FIG. 6, greatly simplifies the portability and installation of the device as it is so to speak, fully assembled and self-ballasted, i.e., is of a weight which is sufficient to retain the member 30 on a sloping roof without the need for additional hold-down devices, adhesives, or the like. Block 30 is preferably dipped in melted wax to provide the water-proof coating, shown in FIG. 6. However, any other suitable water-proof material capable of withstanding outdoor weather conditions may be used. The block 30 need not be a rectangular parallelepiped so long as at least one surface thereof is substantially flat.

It can thus be seen that the present invention provides a unique and yet simple and inexpensive apparatus and method for preventing the icing up of roofs and the blockage of gutters, downspouts, roof drains and the like.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention described herein.

What is claimed is:

1. An apparatus for preventing formation of ice on a roof having a sloped surface and a drain, the apparatus comprising:

a block of salt including a top surface, at least one side surface and a substantially flat surface to support the block upon said surface of said roof; and a water-proof material coating said top surface and a first portion of said at least one side surface of said block to protect said top surface and said first portion of said at least one side surface from rapid breakage due to precipitation;

whereby said substantially flat surface and a second portion of said at least one side surface remain uncoated, so that when water flows down said roof surface some of said salt is dissolved in said water, thereby producing a saline solution.

2. The apparatus of claim 1, wherein said water-proof material comprises wax.

3. The apparatus of claim 1, wherein said block of salt is a rectangular parallelepiped.

4. The apparatus of claim 1, wherein said block is of a size and weight sufficient to retain said block in place on said roof surface without the need for separate fastening members.

5. A method of preventing the formation of ice on a roof having a sloped surface and a drain, the method comprising the steps of:

providing a block of salt including a top surface, at least one side surface and a substantially flat bottom surface;

coating said top surface and a first portion of said at least one side surface of said block with a water-proof material to protect said block from rapid breakage due to precipitation, whereby said bottom surface and a second portion of said at least one side surface remains uncoated; and arranging said block on said roof with said bottom surface facing said roof surface, whereby when water flows down said roof, some of said salt is dissolved in water, thereby producing a saline solution.

6. The method of claim 5, wherein said coating step comprises the step of coating said block with wax.

7. The method of claim 5, wherein said providing step comprises providing a block of salt having the shape of a rectangular parallelepiped.

8. The method of claim 5, wherein said providing step comprises providing a block of salt that is of sufficient size and weight to retain said block on said roof surface without the need for separate fastening members.

* * * * *